US008087915B2

(12) United States Patent
Cadeddu

(10) Patent No.: US 8,087,915 B2
(45) Date of Patent: Jan. 3, 2012

(54) ROTARY PUMP WITH VANE SUPPORT DIVIDED INTO TWO HALF SHELLS

(75) Inventor: Leonardo Cadeddu, Crema (IT)

(73) Assignee: VHIT S.p.A., Offanengo (IT)

( * ) Notice: Subject to any disclaimer, the term of this patent is extended or adjusted under 35 U.S.C. 154(b) by 468 days.

(21) Appl. No.: 12/442,221

(22) PCT Filed: Sep. 11, 2007

(86) PCT No.: PCT/EP2007/007970

§ 371 (c)(1),
(2), (4) Date: Mar. 20, 2009

(87) PCT Pub. No.: WO2008/034551

PCT Pub. Date: Mar. 27, 2008

(65) Prior Publication Data

US 2010/0028189 A1 Feb. 4, 2010

(30) Foreign Application Priority Data

Sep. 21, 2006 (IT) ..... TO2006A0673

(51) Int. Cl.
*F03C 2/00* (2006.01)
*F03C 4/00* (2006.01)
*F04C 18/00* (2006.01)

(52) U.S. Cl. ..... 418/255; 418/185; 418/253; 418/270

(58) Field of Classification Search ..... 418/185, 418/186, 253, 255–258, 270
See application file for complete search history.

(56) References Cited

U.S. PATENT DOCUMENTS

| | | | | | |
|---|---|---|---|---|---|
| 140,914 | A * | 7/1873 | Grotz | ..... | 418/255 |
| 1,626,510 | A * | 4/1927 | Chase | ..... | 418/255 |
| 2,200,198 | A * | 5/1940 | Beach | ..... | 418/184 |
| 3,642,390 | A * | 2/1972 | Ostberg | ..... | 418/255 |
| 4,432,711 | A * | 2/1984 | Tsuchiya et al. | ..... | 418/255 |
| 4,490,100 | A | 12/1984 | Okazaki | | |
| 6,655,937 | B2 * | 12/2003 | Hasert et al. | ..... | 418/152 |

FOREIGN PATENT DOCUMENTS

| | | |
|---|---|---|
| DE | 2658366 | 7/1978 |
| DE | 102004034925 | 2/2006 |
| JP | 2004285978 A * | 10/2004 |

OTHER PUBLICATIONS

International Search Report dated Jan. 29, 2008, in PCT application.

* cited by examiner

*Primary Examiner* — Theresa Trieu
(74) *Attorney, Agent, or Firm* — Young & Thompson

(57) ABSTRACT

A rotary pump includes a stator having a chamber delimited by a circumferential wall, a cylindrical rotor tangent to the circumferential wall of the chamber and suitable for being driven in rotation around an axis eccentric with respect to the chamber, and at least a vane diametrically traversing the rotor by delimiting in the rotor two half shells, mutually separated by the walls guiding the vane. The two half shells are hollow, and inside these hollow half shells are housed elastic leaf springs forming one-way valves with respect to four passageways formed in the half shells; the discharge of the air-oil mixture takes place, after a centrifugation and a partial recycling, through passageways, also in the case of a counter rotation of the pump. This configuration allows a bidirectional use of the same rotor.

14 Claims, 4 Drawing Sheets

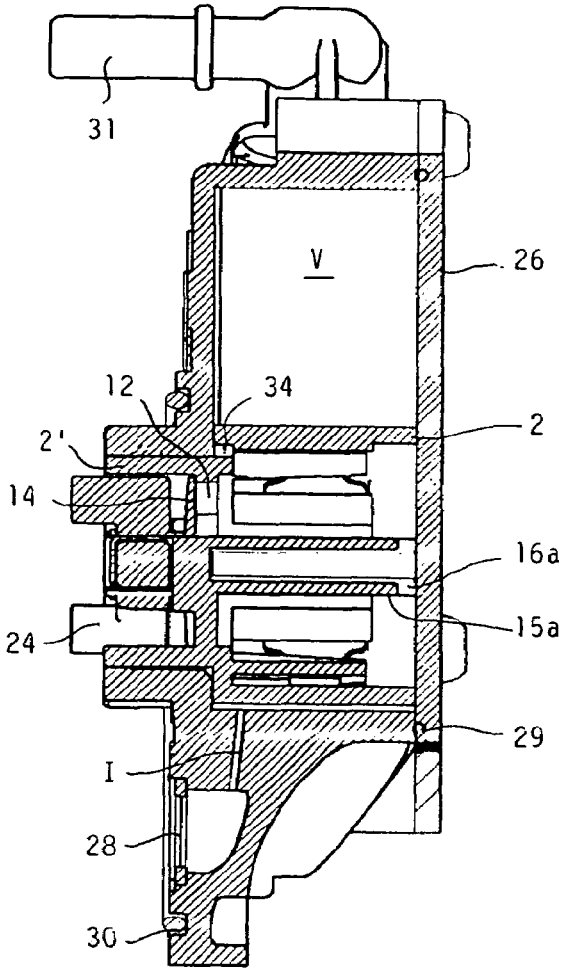
FIG. 5
FIG. 6
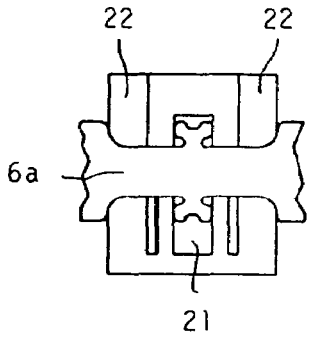
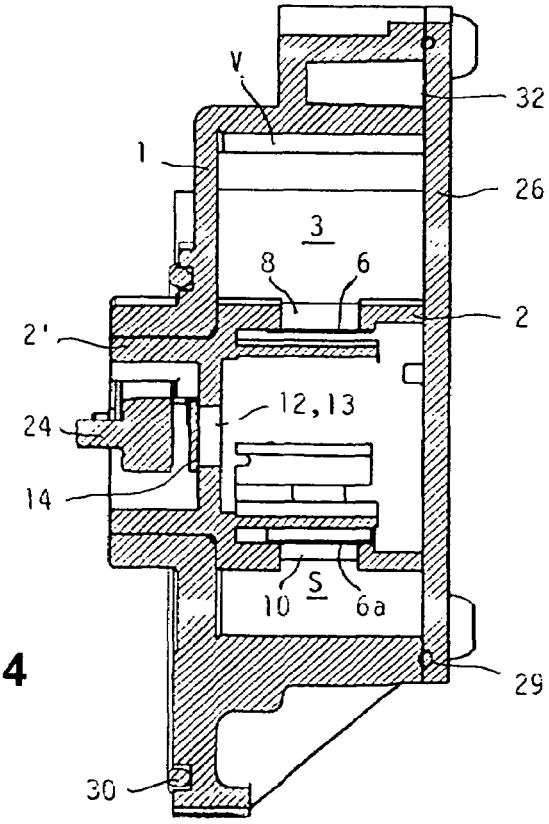
FIG. 4

ROTARY PUMP WITH VANE SUPPORT DIVIDED INTO TWO HALF SHELLS

CROSS-REFERENCE TO RELATED APPLICATIONS

The instant application claims priority to PCT/EP2007/007970 filed Sep. 11, 2007 and Italian Application TO 2006 A 000 673 file Sep. 21, 2006.

STATEMENT REGARDING FEDERALLY SPONSORED RESEARCH OR DEVELOPMENT

None.

THE NAMES OF THE PARTIES TO A JOINT RESEARCH AGREEMENT

None.

INCORPORATION-BY-REFERENCE OF MATERIAL SUBMITTED ON A COMPACT DISC

None.

BACKGROUND OF THE INVENTION (1) Field of the Invention

The subject of this invention is a rotary pump of the type using vanes. More in detail, this invention concerns a rotary pump of the type comprising a stator, in this stator a chamber delimited by a peripheral wall, formed in said stator an inlet connection and an exit passageway, an inlet passageway formed in said stator and extending from said inlet connection to said chamber, within said chamber a rotor, mounted revolving around an axis eccentric with respect to said chamber, said rotor having a support portion, a vane supporting portion and mechanical coupling means intended for driving the rotor in rotation, said vane supporting portion of the rotor being tangent to a region of the peripheral wall of said chamber, said vane supporting portion of the rotor having two parallel walls that delimit a diametrical space and divide the vane supporting portion in two half shells, and at least one vane, mounted sliding in said diametrical space of the vane supporting portion and tangent at its end portions to the peripheral wall of said chamber.

(2) Description of Related Art

Several vane pumps of the above mentioned type are known, and they may have a single vane inserted in said diametrical space of the rotor, said single vane cooperating with opposite portions of the peripheral wall of said chamber, which in this case should have a special outline similar to an ellipse and therefore is usually described as ellipsoidal. Otherwise, these pumps may have two vanes inserted in said diametrical space of the rotor, extending in mutual continuation and cooperating with opposite portions of the peripheral wall of said chamber, which in this case may have a circular outline.

In every case, the single vane or the two vanes and the tangency of the rotor to the peripheral wall of the chamber subdivide the pump chamber by defining therein a suction chamber and a compression chamber, and the rotation of rotor causes a periodical volume modification of said suction and compression chambers. When the rotation of rotor is driven in a suitable sense, it causes a suction from the inlet connection and a delivery from the exit passageway. A rotation of the rotor in the opposite sense would cause an inversion of these operations. To the inner space of pump is supplied oil having the double function of lubricating and of improving the pneumatic sealing of the component parts having a relative movement.

These pumps are widely used in several technical fields, and an application very extended of them is for producing a depression in a reservoir, such depression being used for operating some apparatuses. These pumps are defined vacuum pumps, and they are provided with a one-way valve controlling the suction passageway. In the field of motor vehicles, such vacuum pumps are driven by a cam shaft of the engine, or by another engine driven shaft, and they are especially used for operating the servo systems for the assisted braking, and other pneumatic effectors. In view of the prevailing character of this use, the same will be considered in the following description, being however understood that the described pump can be used for several other applications in the field of motor vehicles as well as in other technical fields.

In the known embodiments, these pumps give satisfactory performances, however they have some drawbacks. Particularly, the pump cannot be driven in the sense opposite the prescribed sense without inverting its operation. Therefore it is needed that differently designed pumps are manufactured, in order to satisfy the requirements for operating the same in opposite senses. Moreover, heavy consequences may take place if a vacuum pump is driven in the sense opposite the prescribed sense, as it may happen when the vehicle engine is subjected to a counter rotation. In this case overload are produced, that may cause the breaking of some component parts.

In the region of tangency between the rotor and the peripheral wall of the chamber, generally is formed a dead space which causes a reduction in the performances and an increase in the power required for operating the pump. The pump needs that a discharge valve is installed, which renders more complicated the installation of the pump on the engine. Also, the supply to the pump of the oil intended to lubricating the component parts thereof involves some difficulties.

BRIEF SUMMARY OF THE INVENTION

The main object of the present invention is to remedy to the disadvantages of the known pumps of the considered type. A special object of the invention is to confer to the pump rotor the characteristic of correctly operating irrespective of the rotation sense imparted to it. This allows unifying the manufacture and the store of pump component parts, and above all prevents any harmful consequence in the case of any accidental counter rotation of the pump. Other objects of the invention are to reduce the resistance torque and the instantaneous torque absorbed by the pump, to render more easy the installation of the pump, to better exploit the lubricant oil, to eliminate the dead space and also, thanks to the better design allowed by the characteristics of the pump, to reduce the production cost and the weight of the pump.

According to the invention, these objects are attained, in a pump as defined in the preamble, by the facts: that every half shell of the vane supporting portion of the rotor is hollow; that every half shell has at each end in the circumferential direction an inlet passage opening at the surface of the vane supporting portion and communicating with the hollow space of the half shell; that each said inlet passage of the half shells is controlled by a one-way valve so arranged as to allow a flow from the outside of the vane supporting portion towards said hollow space of the half shell; and that each half shell has, at the end portion of the vane supporting portion facing the support portion, a discharge opening.

Thanks to these characteristics, when the rotor is put in rotation in the prescribed sense and the displacement of the vane in the chamber causes a compression in the compression chamber and a suction in the suction chamber, the fluid that is present in the compression chamber, which now is compressed, can open the one-way valve which is situated in this chamber, and thus it can flow into the hollow space of the corresponding half shell, from which then the fluid comes out through the corresponding discharge opening; all other one-way valves remain closed and idle. But, if the rotor is put in rotation in the sense opposite the prescribed sense (counter rotation), the compression is then operated in the suction chamber, but it does not cause a clamping of the pump and the consequent damages, because the fluid present in the suction chamber, which now is compressed, can open the one-way valve which is situated in this chamber, and thus it can flow into the hollow space of the corresponding half shell, from which then the fluid comes out through the corresponding discharge opening; all other one-way valves remain closed and idle. Therefore, all heavy consequences of an accidental counter rotation of the pump are prevented.

Of course, the rotor structure being completely symmetrical, this rotor can be used in any stator, irrespective of the fact that the stator is intended for a clockwise rotation of the pump or for a counterclockwise rotation of the pump, or even for a bi-directional operation.

The rotary pump according to the above definition may preferably comprise one or more of the following characteristics:

Every inlet passage of each half shell of the rotor vane supporting portion is situated near the center of the half shell along its axial direction, it is extended in the circumferential direction towards the vane supporting wall and it forms inwardly a seat for one of the one-way valves. In this way, the dead space is eliminated.

Said one-way valves are formed, for each half shell, by an elastic leaf spring which is supported near its center and forms, near its ends, the two one-way valves for the half shell.

In the hollow space of each half shell are provided conformations suitable for positioning, conforming and putting in pre-tension said elastic leaf spring forming the valves.

Alternatively, said one-way valves are formed, for each half shell, by two plate valves pivoted near the center of the half shell along its circumferential direction, and each provided with a partial counterweight situated opposite the plate valve with respect to the pivot center.

All the elements of plate valve with counterweight can be identical in shape and differ only for their assemblage positions within the half shells.

In the hollow space of each half shell are provided conformations suitable for limiting the opening of the valves.

Each said parallel walls of the rotor vane supporting portion is provided, on the surface facing the vane, with lubrication channels communicating with the hollow space of the corresponding half shell.

The rotor support portion has, on its side opposite the vane supporting portion, a seat for intermediate driving elements intended for compensating any coaxiality error between the pump and a shaft operating the pump driving.

The stator is devoid of discharge connection and valve for air and oil.

Said stator has a channel for supplying oil in the suction chamber. This renders more simple the installation of the pump.

Said channel for supplying oil can be provided with a valve of minimum pressure.

Said stator comprises a plane cover which has no guide function.

BRIEF DESCRIPTION OF THE SEVERAL VIEWS OF THE DRAWING

These and other features, objects and advantages of the subject of the present invention will more clearly appear from the following description of some preferred but not limiting embodiments, and from the consideration of the accompanying drawings, wherein:

FIG. 4 shows a longitudinal section taken according to the broken line IV-IV of FIG. 2.

FIG. 5 shows a longitudinal section taken according to the broken line V-V of FIG. 2.

FIG. 6 shows a detail, viewed from inside the vane supporting portion, of the axial and radial positioning of an elastic leaf spring.

DETAILED DESCRIPTION OF THE INVENTION

In the following description, the pump is considered in its embodiment as vacuum pump for automotive application, but those skilled in the art will easily sense the particular modifications needed for implementing this pump to different applications.

Figure 1:
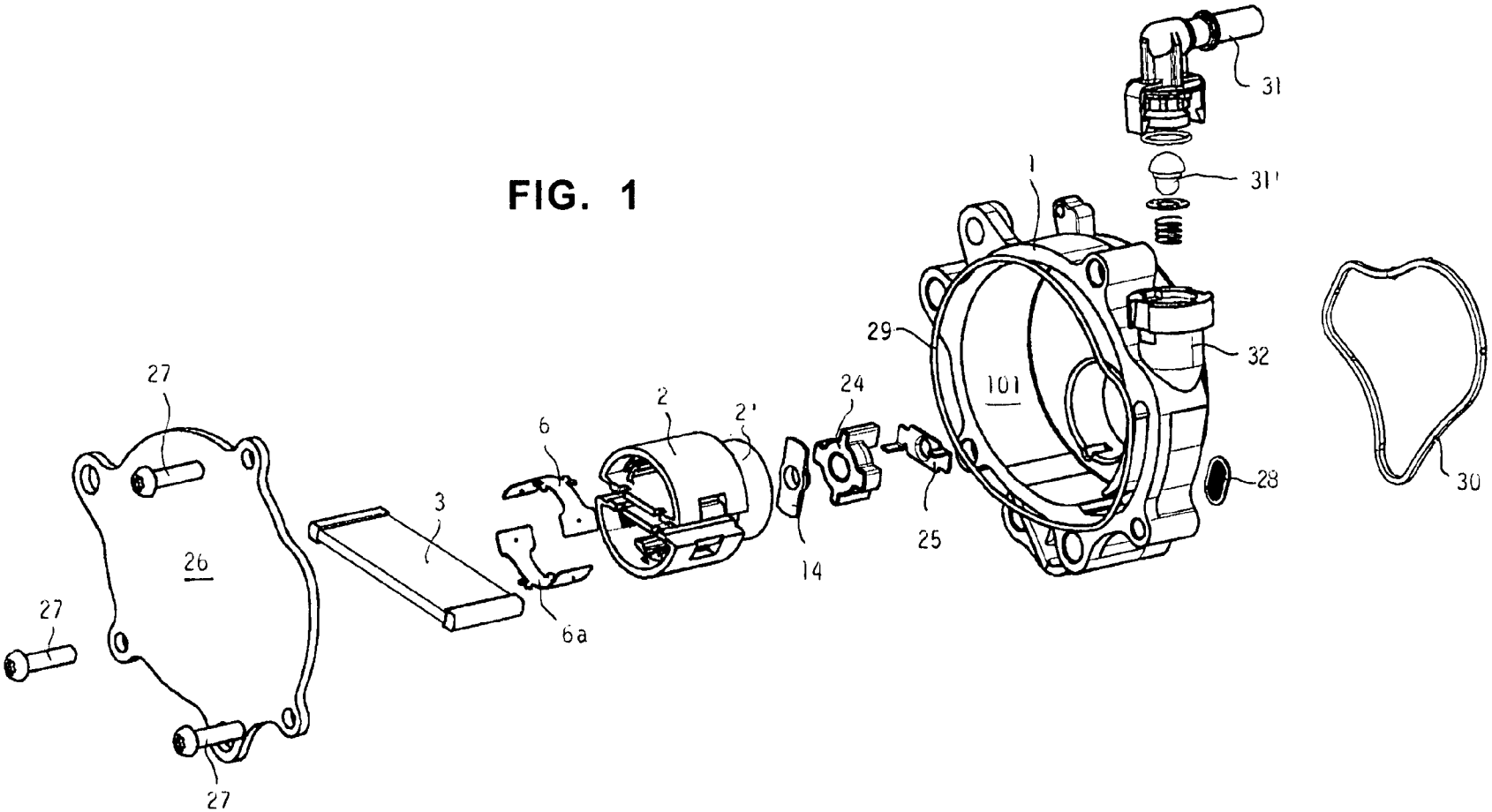
FIG. 1 is an exploded perspective view of the component parts forming the pump, according to a first embodiment of the present invention.

FIG. 1 represents an exploded perspective view or the component parts forming a pump according to the present invention, and in this Figure one may particularly observe a stator 1, a rotor 2, a vane 3, two elastic leaf springs 6 and 6*a*, an optional valve 14, two intermediate driving elements 24 and 25, a cover 26, three screws 27 for fixing the cover 26, a filter 28, two sealing packings 29 and 30 and a unit 31 for taking the vacuum, comprising a one-way valve.

Figure 2:
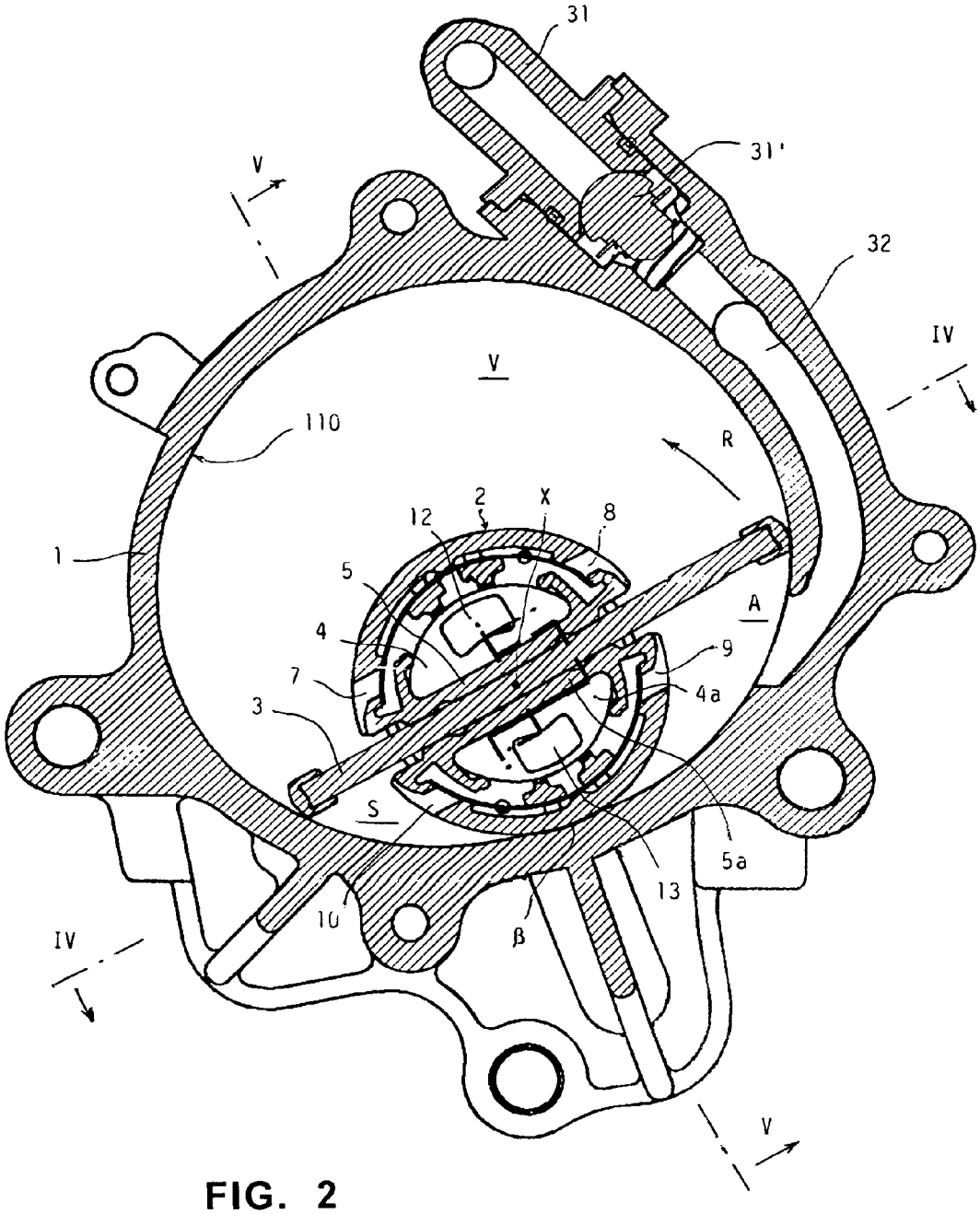
FIG. 2 is a view in cross section of a pump formed by the component parts according to FIG. 1.
Figure 3:
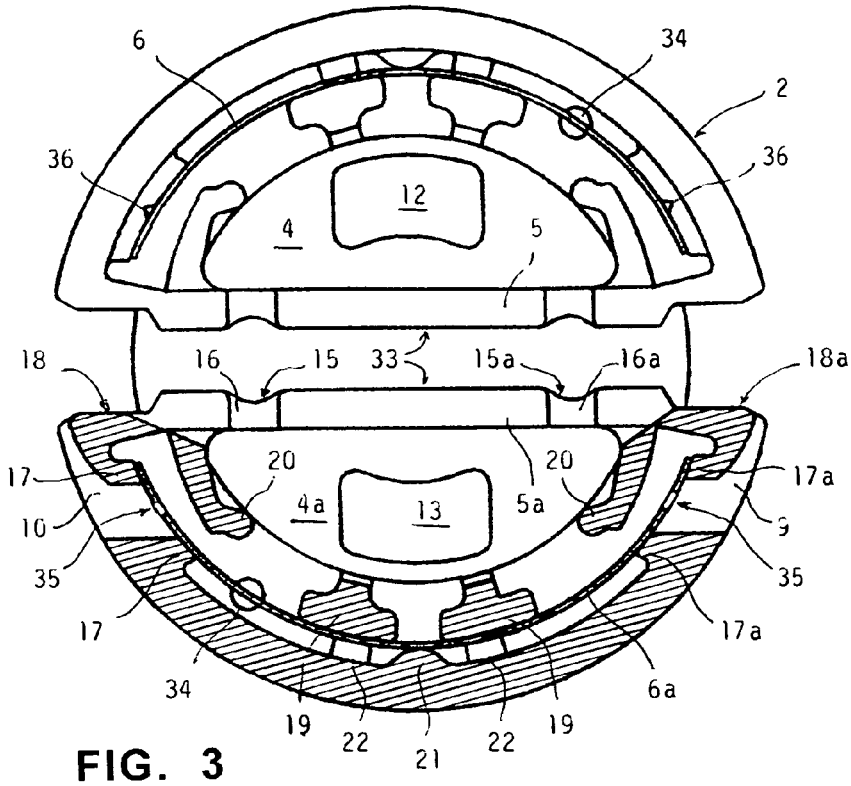
FIG. 3 is a view on a larger scale of the vane supporting portion of the rotor, partially in a cross section.

With reference to FIG. 2, and for the rotor details to FIG. 3, the stator 1 comprises a chamber V delimited by a peripheral wall 110, and an inlet passageway 32 extending from an inlet connection 31, provided with an inlet one-way valve 31', up to a suction chamber A. Within said chamber V is housed the vane supporting portion 2 of a rotor which is mounted revolving around an axis X eccentric with respect to said chamber V. Said rotor vane supporting portion 2 is tangent along an angle β to a region of said peripheral wall 110 of the chamber V, and it comprises two parallel walls 5 and 5*a* delimiting a diametrical space and dividing the vane supporting portion 2 into two half shells 4 and 4*a*. At least one vane 3 is mounted sliding in said diametrical space of the vane supporting portion 2, it is tangent with its end portions to the peripheral wall 110 of the chamber V, and defines within this chamber a suction chamber A and a compression and discharge chamber S. Each half shell 4 and 4*a* of the rotor vane supporting portion 2 is hollow and it has at each end (considered along the circumferential direction) a radial inlet passage 7, 8, 9 and 10, opening at the surface of the vane supporting portion 2 and communicating with the hollow space of the corresponding half shell 4, 4*a*.

Each said inlet passage 7 to 10 is controlled by a one-way valve arranged for allowing a flow from outside the vane supporting portion 2 to said hollow space of the corresponding half shell. Each half shell 4 and 4*a* has, at an end of the vane supporting portion 2, a discharge opening 12, 13.

The inlet passages 7 to 10 extend, by narrowing, towards the end portions 18 and 18*a* of the walls 5 and 5*a* which define the space for the vane 3. In this way, the dead space is completely eliminated.

In this embodiment, the two one-way valves of each half shell 4, 4*a* are formed by an elastic leaf spring 6, 6*a*, which takes the represented configuration thanks to rest and support elements 19, 22 formed on the corresponding half shell, and it closes the passages 7 to 10 in correspondence with conformations 17, 17*a* that define valve seats. Some protrusions 20 of the half shell limit the lifting capability of the leaf springs 6, 6*a* in order to prevent an excessive deformation thereof. A preferred means intended for axially and radially positioning each elastic leaf spring is represented in FIG. 6, where it is viewed from inside.

When rotor 2 is put in counterclockwise rotation according to arrow R, the displacement of vane 3 causes the volume of the suction chamber A to increase and therefore produces a fluid suction through the passageway 32, and at the same time the displacement of vane 3 causes the volume of the compression chamber S to reduce. Then the fluid present in the compression chamber S, which undergoes a pressure increase, is put in condition to lift the one-way inlet valve closing the inlet passage 10, and it enters the hollow space of the half shell 4*a*. From there the fluid passes through the exit opening 13 and comes out of the pump.

Of course, after a half turn of rotor 2 the half shells 4 and 4*a* invert their positions and operations, along with all the respective component parts. The operation now described is the normal operation of the pump.

If on the contrary, due to a counter rotation of the pump, the rotor 2 is rotated in the sense contrary to that of arrow R, this causes a compression in the suction chamber A, and according to the known technique would cause the consequent heavy results. But with the pump according to this invention the fluid compressed in the suction chamber A is capable of lifting the one-way inlet valve closing the inlet passage 9, and to enter the hollow space of the half shell 4*a*. From there the fluid passes through the exit opening 13 and comes out of the pump, without having caused any harmful result. Therefore the pump according to the invention can be subjected to any accidental counter rotation without suffering damages.

Oil, coming from the engine lubrication system through a connection 28 (FIG. 5) provided with a filter, is introduced in the chamber V, preferably in the suction chamber A, through a passage I. It lubricates the parts subjected to mutual movements, and it improves the pneumatic sealing. This oil, along with the air present in the chamber V, forms a mixture of air and oil which, during the compression step, enters the hollow space of the half shell 4*a* through the passage 10. The oil component of this mixture is expelled in part, in pulverized form, towards the chamber V and the suction chamber A through little bores 35 or scratches 36, and it enters through apertures 16 and 16*a* into ducts 15 and 15*a*, in order to lubricate the contact region 33 between the vane 3 and the guide walls 5 and 5*a*. During the rotation, the mixture of air and oil is centrifuged and partially separated, whereby the air that is discharged from the hollow space of the half shell 4*a* through the exit opening 13 has been in part cleared from the oil. A lubrication hole 34 is provided in the peripheral region of the half shell 4*a*, where the oil tends to collect due to the centrifugation, and this hole directs the oil in the region in which the half shell is connected to the radial guide of the rotor, thus lubricating this region and improving its pneumatic sealing.

Referring now to FIGS. 4 and 5, it is to be observed that the air discharged through the discharge openings 12 and 13 traverses the one-way valve 14. This valve is an optional element that is not essential but is useful with a protection function, and it can be formed by a flexible material such as rubber. This air is then discharged through the region in which are situated the intermediate driving elements 24 and 25, and this region forms the exit passage and connection from which the air, still in part mixed with oil, can be directed inside the engine or to a duct for oil recuperation.

As it may be observed, in the pump according to the invention the lubricating fluid is better exploited, and it can flow out without encounter obstacles nor direction inversions, thus giving rise to a reduction of the torque absorbed by the pump. From the reduced stress of the component parts results the possibility of a pump design in more favorable conditions of weight and cost. Particularly, the lubricant fluid, sprinkled in the suction chamber and pulverized by the depression, lubricates the contact of the vane with the stator walls and, after having entered the rotor, lubricates the contact surface between the rotor and the cover, the gliding contact surfaces between the vane and the rotor vane supporting portion, the rotor guides and the intermediate driving elements, whereas the centrifugation operates a partial separation of the oil from the air and allows recycling a noticeable part of the oil, thus reducing the lubricant oil quantity needed, with respect to a known pump.

Figure 7:
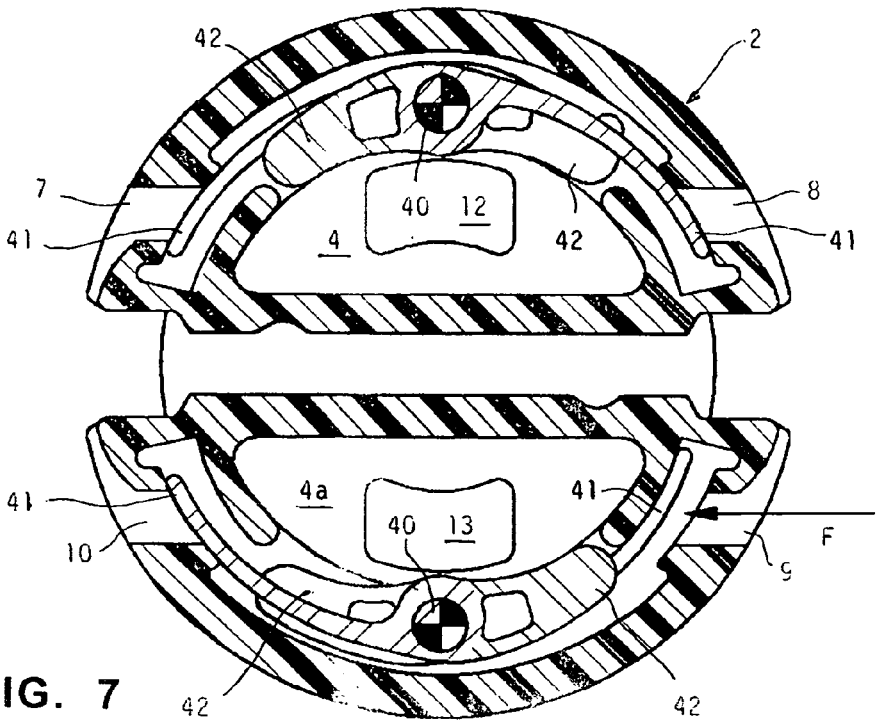
FIG. 7 is a view on a larger scale and in cross section of the rotor vane supporting portion according to a second embodiment of the invention.

In FIG. 7 is represented a rotor being a modified embodiment with respect to the already described rotor represented in FIG. 3. In this embodiment, the one-way valves controlling the inlet passages 7 to 10 of the half shells 4 and 4*a* are formed by plate members 41, pivoted on a axis 40 which is central with respect to the longitudinal direction of the half shell 4 or 4*a*, and cooperating with the passages 7 to 10 for controlling the same. Each plate valve 41 is extended, on the opposite side of axis 40, to form a body 42 having a moment of inertia with respect to the axis 40 slightly smaller than the moment of inertia of the plate valve 41 with respect to the same axis. Therefore, the centrifugal force acting on the plate valves 41 is in part compensated by the centrifugal force acting on the bodies 42, which thus form partial counterweights. In any case, the plate valves 41 are pushed by the centrifugal force to close the passages 7 to 10, but the presence of the counterweights 42, designed in a right measure, allows suitably limiting the closure force of the plate elements 41 operating as one-way valves. In FIG. 7, the one-way valves corresponding to the passages 7, 8 and 10 are represented in closed position, whereas the one-way valve corresponding to the passage 9 is represented in open position. In this condition, the fluid enters the half shell 4*a* through the passage 9 according to arrow F.

With a suitable design it is possible to assign to all the valve elements 41-42 identical shapes, whereby a single component part has to be manufactured, and it will be mounted, in different assemblage positions, in order to form all the valves of a pump.

It should be understood that also different shapes of these valves could be chosen by the designer, and that all what has been described and represented has no limiting character, because several modifications can be made in the design without departing from the spirit of the invention, within the scope determined by the Claims.

The invention claimed is:

1. A rotary pump of the type comprising:

a stator (1), in this stator a chamber (V) delimited by a peripheral wall (110), formed in said stator an inlet connection (31) and an exit passageway, an inlet passageway (32) formed in said stator (1) and extending from said inlet connection (31) to said chamber (V), within said chamber a rotor (2), mounted revolving around an axis (X) eccentric with respect to said chamber (V), said rotor having a support portion (2'), a vane supporting portion (2) and mechanical coupling means (24,25) intended for driving the rotor in rotation, said vane supporting portion (2) of the rotor being tangent (β) to a region of the peripheral wall (110) of said chamber (V), said vane supporting portion (2) of the rotor having two parallel walls (5, 5*a*) that delimit a diametrical space and divide the vane supporting portion (2) in two half shells (4,4*a*), and at least one vane (3), mounted sliding in said diametrical space of the vane supporting portion (2) and tangent at its end portions to the peripheral wall (110) of said chamber, wherein:

every half shell (4,4*a*) of the vane supporting portion (2) of the rotor is hollow;

every half shell (4,4*a*) has at each end in the circumferential direction a radial inlet passage opening (7,8,9,10) opening at the surface of the vane supporting portion (2) and communicating with the hollow space of the half shell (4,4*a*);

each said inlet passage (7,8,9,10) of the half shells is controlled by a one-way valve (6,6*a*; 41) so arranged as to allow a flow from the outside of the vane supporting portion (2) towards said hollow space of the half shell (4,4*a*);

and each half shell (4,4*a*) has, at the end portion of the vane supporting portion (2) facing said support portion (2'), a discharge opening (12,13).

2. The rotary pump according to claim 1, wherein every inlet passage (7,8,9,10) of each half shell (4,4*a*) of the rotor vane supporting portion (2) is situated near the center of the half shell along the axial direction, extended in the circumferential direction towards the vane supporting wall (5,5*a*) and forms inwardly a seat for one of the one-way valves.

3. The rotary pump according to claim 1, wherein said one-way valves (6,6*a*) are formed, for each half shell (4,4*a*), by an elastic leaf (6,6*a*) which is supported near said one-way valves center and forms, near said one-way valves ends, the two one-way valves for the half shell (4,4*a*).

4. The rotary pump according to claim 3, wherein the hollow space of each half shell (4,4*a*) are provided conformations (19,21,22) suitable for positioning, conforming and putting in pre-tension said elastic leaf springs (6,6*a*) forming the valves.

5. The rotary pump according to claim 3, in wherein the hollow space of each half shell (4,4*a*) is provided conformations (20) suitable for limiting the opening of the valves.

6. The rotary pump according to claim 1, wherein said one-way valves are formed, for each half shell (4,4*a*), by two plate valves (41) pivoted near the center (40) of the half shell (4,4*a*) along a longitudinal direction, and each plate valve (41) being provided with a partial counterweight (42) situated opposite the plate valve (41) with respect to the pivot center (40).

7. The rotary pump according to claim 6, wherein the elements forming each plate valve (41) and the counterweight (42) are all identical in shape and differ only for their assemblage positions within the half shells (4,4*a*).

8. The rotary pump according to claim 6, wherein the hollow space of each half shell (4,4*a*) is provided conformations (20) suitable for limiting the opening of the valves.

9. The rotary pump according to claim 1, wherein each said parallel wall (5, 5*a*) of the rotor vane supporting portion (2) is provided, on the surface (33) facing the vane (3), with lubrication channels (15,15*a*) communicating with the hollow space of the corresponding half shell (4,4*a*).

10. The rotary pump according to claim 1, wherein the rotor support portion (2') has, on a side opposite the vane supporting portion (2), a seat for intermediate driving elements (24,25) intended for compensating any coaxiality error between the pump and a shaft operating the pump driving.

11. The rotary pump according to claim 1, wherein the stator (1) is devoid of a connection and a valve for discharging air and oil.

12. The rotary pump according to claim 1, wherein said stator (1) has a channel (I) for supplying oil in the suction chamber (A).

13. The rotary pump according to claim 11, wherein said channel (I) for supplying oil is provided with a valve of minimum pressure.

14. The rotary pump according to claim 1, wherein said stator (1) comprises a plane cover (26) which has no guide function.

* * * * *